US006769927B2

(12) United States Patent
Brewer

(10) Patent No.: US 6,769,927 B2
(45) Date of Patent: Aug. 3, 2004

(54) CARD RETENTION DEVICE

(75) Inventor: James Brewer, Leander, TX (US)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 10/197,786

(22) Filed: Jul. 18, 2002

(65) Prior Publication Data

US 2004/0014347 A1 Jan. 22, 2004

(51) Int. Cl.[7] ..... H01R 13/62
(52) U.S. Cl. ..... 439/328
(58) Field of Search ..... 439/327, 328, 439/357, 358; 361/749, 759, 801

(56) References Cited

U.S. PATENT DOCUMENTS 3,932,016 A * 1/1976 Ammenheuser ..... 439/377
4,445,742 A * 5/1984 Fullam ..... 439/597
5,154,629 A * 10/1992 Carver et al. ..... 439/352
5,423,691 A * 6/1995 Pickles ..... 439/327
5,454,726 A * 10/1995 Lee et al. ..... 439/65
5,494,451 A * 2/1996 Bowers ..... 439/328
5,967,633 A * 10/1999 Jung ..... 312/223.2
6,183,284 B1 2/2001 Gill et al.
6,319,037 B1 * 11/2001 Lai ..... 439/327
6,370,036 B1 * 4/2002 Boe ..... 361/801
6,394,831 B1 * 5/2002 Bowers et al. ..... 439/327

* cited by examiner

*Primary Examiner*—Javaid H. Nasri
(74) *Attorney, Agent, or Firm*—Haynes and Boone, LLP

(57) ABSTRACT

Apparatus for securing an I/O card in a connector includes a connector having a catch. A card is removably mounted in the connector by a card retention member which is movably mounted on the card. The retention member includes a hook and is resiliently urged to a first position wherein the hook engages the catch. The retention member is movable to a second position wherein the hook is released from the catch allowing the I/O card to be removed.

20 Claims, 3 Drawing Sheets

CARD RETENTION DEVICE

BACKGROUND

The disclosures herein relate generally to information handling systems and more particularly to a card retention device for use in such systems.

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Current PCI cards and other I/O cards are inserted into a system slot and either locked down with a lever or a screw. During shipping or customer handling, the card edge tab connector end furthest away from the locked I/O bracket may partially or completely slip out of the motherboard socket. This problem tends to occur with cards that have a lot of mass or cards that are inserted into shorter edge-tab connectors. When the problem occurs, a service call is generated because the I/O card becomes physically disconnected from the motherboard and can no longer respond to system commands.

AGP cards utilize an "L" shaped hook built into the card just beyond the connector edge tab. To insert or remove an AGP card, the user must reach down and hook (or unhook) a retention strap which is fixed into the motherboard. This is very inconvenient and often causes a service call when a customer doesn't realize the card has a retention strap and therefore doesn't release it before removing (or forcing) the AGP card from the system. Some systems design a foam retainer into the case to hold the I/O cards in place. This can work but it diminishes heat flow and is difficult to implement when various heights of cards are used.

Therefore, what is needed is a device for retaining a PCI or other I/O card once it is plugged into a system, that is convenient to access, visible to the user and does not diminish heat flow.

SUMMARY

One embodiment, accordingly, provides an apparatus for securing an I/O computer card. To this end, the apparatus includes a connector having a catch. A card is removably mounted in the connector. A card retention member is movably mounted on the card and includes a hook. The card retention member is resiliently urged into a first position wherein the hook engages the catch, and is movable to a second position wherein the hook is released from the catch.

A principal advantage of this embodiment is that the connector housing is used to lock the I/O card in place. If an I/O card needs retention, a latch is incorporated with the card for engagement with the housing.

DETAILED DESCRIPTION

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

Figure 1:
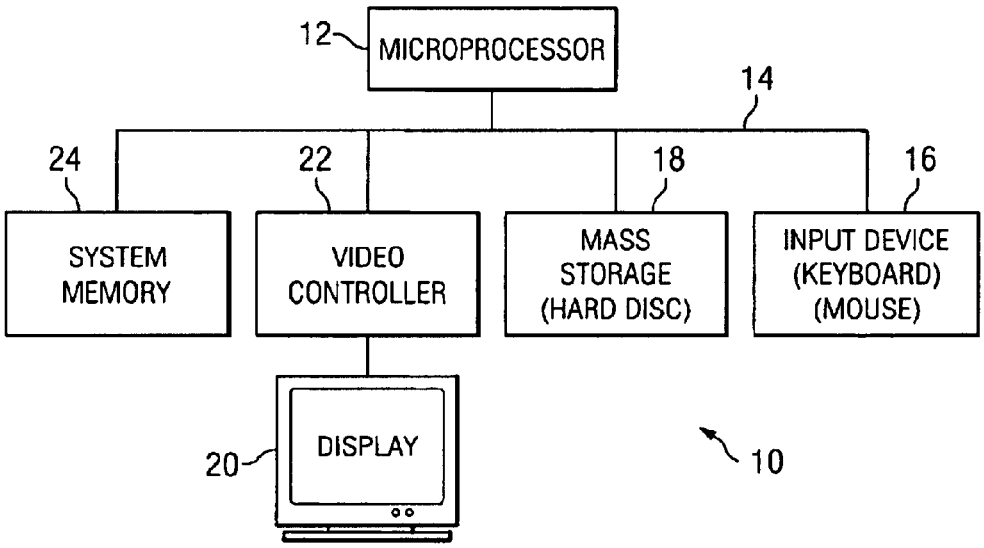
FIG. 1 is a diagrammatic view illustrating an embodiment of a computer system.

In one embodiment, computer system 10, FIG. 1, includes a microprocessor 12, which is connected to a bus 14. Bus 14 serves as a connection between microprocessor 12 and other components of computer system 10. An input device 16 is coupled to microprocessor 12 to provide input to microprocessor 12. Examples of input devices include keyboards, touchscreens, and pointing devices such as mouses, trackballs and trackpads. Programs and data are stored on a mass storage device 18, which is coupled to microprocessor 12. Mass storage devices include such devices as hard disks, optical disks, magneto-optical drives, floppy drives and the like. Computer system 10 further includes a display 20, which is coupled to microprocessor 12 by a video controller 22. A system memory 24 is coupled to microprocessor 12 to provide the microprocessor with fast storage to facilitate execution of computer programs by microprocessor 12. It should be understood that other busses and intermediate circuits can be deployed between the components described above and microprocessor 12 to facilitate interconnection between the components and the microprocessor.

Figure 2:
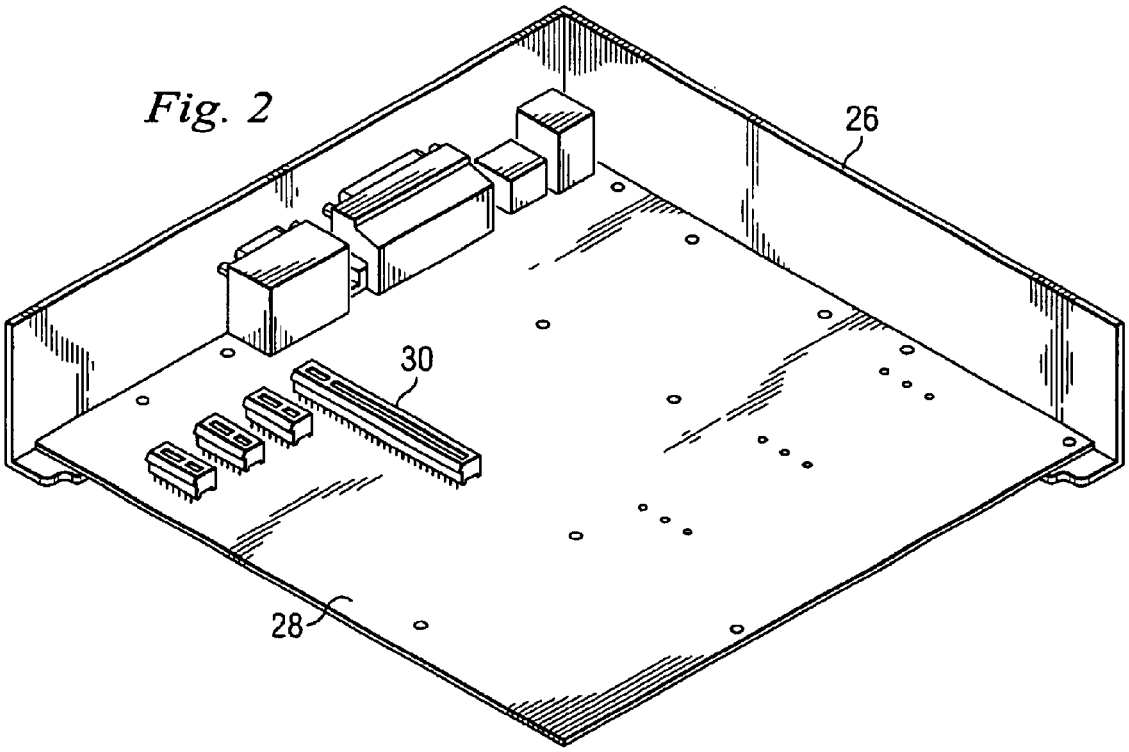
FIG. 2. is a partial perspective view illustrating an embodiment of a computer chassis.

A chassis 26, FIG. 2, is provided with a system board or motherboard 28 to accommodate many of the components of system 10 as described above. Motherboard 28 also carries a connector 30 for receiving a card such as the card 32 illustrated in FIG. 3. The connector 30 includes a slot 31 for removably receiving edge connectors 34 of the card 32. Connector 30 also includes a catch 36. Card 32 further includes a card retention member 38 pivotably mounted thereon at a pivotable connection 40. A first end 42 of card retention member 38 functions as a leverage handle which when moved, pivots a second end 44 of card retention member 38 about pivotable connection 40. Second end 44 includes a hook 46. A resilient member 48 is positioned between retention member 38 and card 32.

Figure 4:
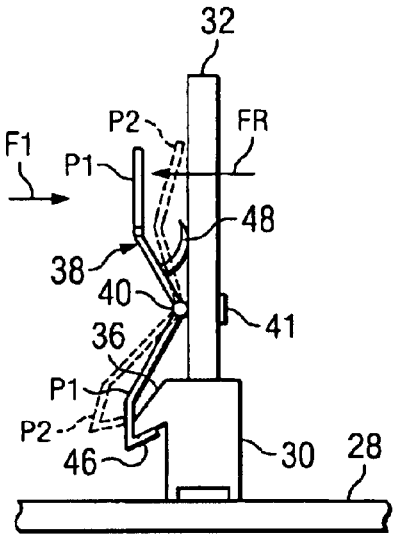
FIG. 4 is an end view illustrating an embodiment of a card inserted and secured in a connector.

Retention member 38, FIG. 4, is movably mounted on card 32 to pivot between a first position P1, wherein the hook 46 is engaged with the catch 36, and a second position P2 wherein the hook 46 is released from the catch 36. The retention member may be moved manually from position P1 to position P2 by application of a force applied in a direction designated by the arrow F1. This force F1 disengages the hook 46 from the catch 36 for removal of card 32 from connector 30.

Figure 4A:
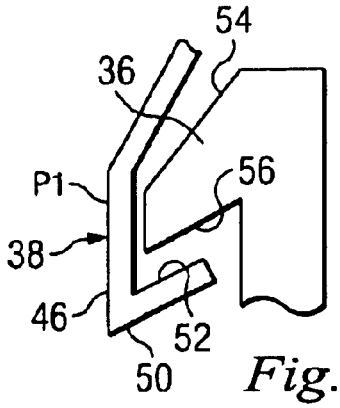
FIGS. 4A and 4B are partial views illustrating an embodiment of a hook and a catch of a card connector system.

Hook 46, FIG. 4A, is provided with a first inclined surface 50 and a second gripping surface 52. Catch 36 is provided with a first inclined surface 54 and a second gripping surface 56.

Figure 4B:
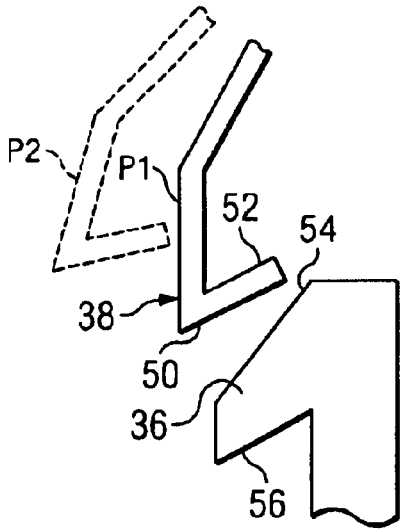

The catch surface 54, FIGS. 4, 4A and 4B, engages the hook surface 50 when card 32 is inserted into connector 30. This moves retention member 38 from position P1 to position P2. When card 32 is fully inserted in connector 30, retention member 38 is resiliently urged to return to its at rest position P1.

Figure 3:
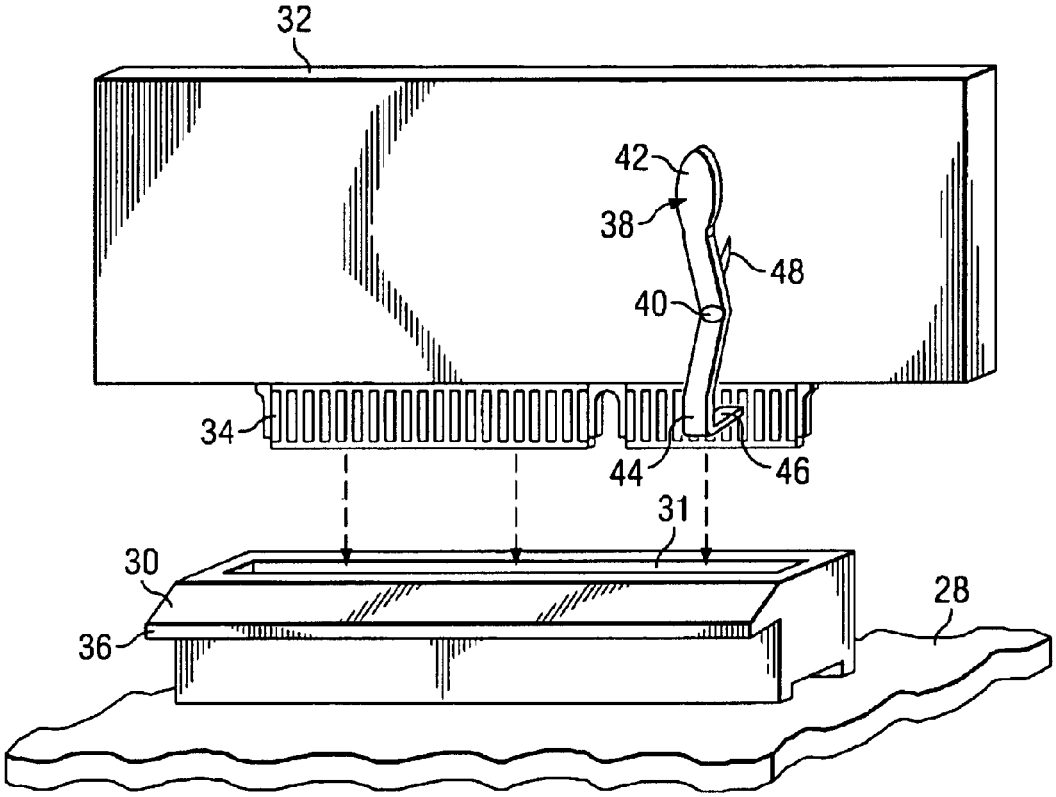
FIG. 3 is a perspective view illustrating an embodiment of a card and a card connector.

This return movement is caused by resilient member 48, FIGS. 3 and 4, which is mounted on retention member 38 and extends into contact with card 32. Thus, when the force F1, FIG. 4, is applied, resilient member 48 is compressed between the retention member 38 and the card 32. The compression stores energy sufficient to automatically apply a return force, illustrated in a direction designated by the arrow FR, to return retention member 38 to position P1, wherein hook 46 engages catch 36.

Figure 5A:
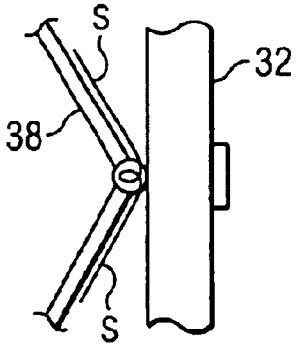
FIGS. 5A and 5B are partial views illustrating alternate embodiments of a pivotable connection between a card and a card retention member.
Figure 5B:
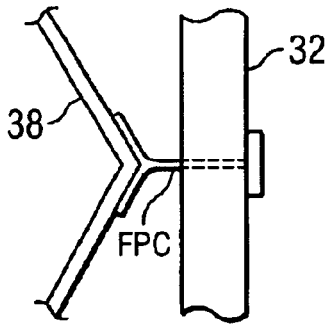

Retention member 38 is thus manually and automatically movable about pivotable connection 40 for removal and insertion, respectively, of card 32 in connector 30. Pivotable connection 40, FIG. 4, is secured to card 32 by a connector 41. Such connection requires minimal space on card 32. It is also possible to provide a pivotable connection which is resiliently mounted on card 32 such as by means of a torsion spring S or a flexible pivotable connection FPC illustrated at FIGS. 5A and 5B.

The connector 30 containing catch 36 should be secured to the system board 28 to reduce shock and vibration stress on electrical pins held within connector 30. Securing the connector 30 is accomplished by using posts (not shown) extending out of the connector 30 and going through the system board 28 where they can either be expanded beyond the size of the post hole or a locking device can be placed on the end of the post.

Although illustrative embodiments have been shown and described, a wide range of modification, change and substitution is contemplated in the foregoing disclosure and in some instances, some features of the embodiment may be employed without a corresponding use of other features. Accordingly, it is appropriate that the appended claims be construed broadly and in a manner consistent with the scope of the embodiments disclosed herein.

What is claimed is:

1. An apparatus for securing an input/output computer card comprising:

a connector in a computer chassis, the connector including a catch;

a card removably mounted in the connector, the card having opposed surfaces; and a card retention member movably mounted on one of the surfaces and including a hook, the card retention member being automatically resiliently urged into a first position wherein the hook engages the catch, and being positioned on the card for manual movement by simultaneous gripping of the card and a leverage handle adjacent the one surface, to a second position wherein the hook is released from the catch.

2. The apparatus of claim 1, wherein the card retention member is resiliently urged by a resilient member engaged between the card and the card retention member.

3. The apparatus of claim 2, wherein the resilient member is attached to the card retention member and extends into engagement with the card.

4. The apparatus of claim 1, wherein the card retention member is pivotally connected to the card.

5. The apparatus of claim 1, wherein the catch includes a first inclined surface for urging the card retention member to the second position.

6. The apparatus of claim 5, wherein the catch includes a gripping surface for maintaining connection with the hook.

7. The apparatus of claim 6, wherein the hook has a first inclined surface for being urged to the second position by the first inclined surface of the catch.

8. The apparatus of claim 7, wherein the hook has a gripping surface for engaging the second inclined surface of the catch.

9. An information handling system comprising:

a chassis;

a microprocessor mounted in the chassis;

a storage coupled to the microprocessor;

a connector including a catch mounted on the chassis;

a card removably mounted in the connector, the card having opposed surfaces; and a card retention member movably mounted on one of the surfaces and including a hook, the card retention member being automatically resiliently urged into a first position wherein the hook engages the catch, and being positioned on the card for manual movement by simultaneous gripping of the card and a leverage handle adjacent the one surface to a second position wherein the hook is released from the catch.

10. The system of claim 9, wherein the card retention member is resiliently urged by a resilient member engaged between the card and the card retention member.

11. The system of claim 10, wherein the resilient member is attached to the card retention member and extends into engagement with the card.

12. The system of claim 9, wherein the card retention member is pivotally connected to the card.

13. The system of claim 9, wherein the catch includes a first inclined surface for urging the card retention member to the second position.

14. The system of claim 13, wherein the catch includes a gripping surface for maintaining connection with the hook.

15. The system of claim 14, wherein the hook has a first inclined surface for being urged to the second position by the first inclined surface of the catch.

16. The system of claim 15, wherein the hook has a gripping surface for engaging the second inclined surface of the catch.

17. A method of securing an I/O card in a connector in a computer housing comprising:

providing a chassis;

providing a connector including a catch mounted on the chassis;

mounting a card in the connector, the card having opposed surfaces;

providing a card retention member movably mounted on one of the surfaces including a hook;

automatically engaging the hook with the catch on the connector in response to inserting the card in the connector; and disengaging the hook with the catch on the connector in response manually simultaneous gripping of the card and moving a leverage handle on the card retention member, the leverage handle being adjacent the one surface.

18. The method of claim 17, wherein the card retention member is pivotally connected to the card.

19. The method of claim 17, wherein the catch includes an inclined surface for moving the card retention member in response to contact with the hook.

20. The method of claim 19, wherein the hook has an inclined surface for moving the card retention member in response to contact with the catch.

* * * * *